US007234524B2

(12) United States Patent
Shaw et al.

(10) Patent No.: US 7,234,524 B2
(45) Date of Patent: Jun. 26, 2007

(54) SUBSEA CHEMICAL INJECTION UNIT FOR ADDITIVE INJECTION AND MONITORING SYSTEM FOR OILFIELD OPERATIONS

(75) Inventors: Christopher Kempson Shaw, Claremore, OK (US); Cindy L. Crow, Sugar Land, TX (US); William Edward Aeschbacher, Jr., Houston, TX (US); Sunder Ramachandran, Sugar Land, TX (US); Mitch C. Means, Richmond, TX (US); Paulo S. Tubel, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 200 days.

(21) Appl. No.: 10/641,350

(22) Filed: Aug. 14, 2003
(Under 37 CFR 1.47)

(65) Prior Publication Data

US 2004/0168811 A1 Sep. 2, 2004

Related U.S. Application Data

(60) Provisional application No. 60/403,445, filed on Aug. 14, 2002.

(51) Int. Cl.
*E21B 37/06* (2006.01)
*E21B 43/01* (2006.01)

(52) U.S. Cl. ..... 166/304; 166/335; 166/368

(58) Field of Classification Search ..... 166/335, 166/351, 368, 366, 250.01, 57, 300, 304
See application file for complete search history.

(56) References Cited

U.S. PATENT DOCUMENTS 3,695,047 A * 10/1972 Pogonowski et al. ..... 405/210
3,780,750 A * 12/1973 Perkins ..... 137/13
4,589,434 A * 5/1986 Kelley ..... 137/1
4,732,215 A * 3/1988 Hopper ..... 166/366
4,848,475 A * 7/1989 Dean et al. ..... 166/357
5,025,865 A * 6/1991 Caldwell et al. ..... 166/366
6,102,124 A * 8/2000 Skeels et al. ..... 166/347
6,196,314 B1 * 3/2001 Chen ..... 166/275
6,281,489 B1 8/2001 Tubel et al.
6,292,756 B1 * 9/2001 Lievois et al. ..... 702/50
6,467,340 B1 * 10/2002 Gallagher et al. ..... 73/152.18
6,536,528 B1 * 3/2003 Amin et al. ..... 166/369

(Continued)

*Primary Examiner*—Jennifer H. Gay
*Assistant Examiner*—Shane Bomar
(74) *Attorney, Agent, or Firm*—Madan, Mossman & Sriram, P.C.

(57) ABSTRACT

A system monitors and controls the injection of additives into formation fluids recovered through a subsea well. The system includes a chemical injection unit and a controller positioned at a remote subsea location. The injection unit uses a pump to supply one or more selected additives from a subsea and/or remote supply unit. The controller operates the pump to control the additive flow rate based on signals provided by sensors measuring a parameter of interest. A one mode system includes a surface facility for supporting the subsea chemical injection and monitoring activities. In one embodiment, the surface facility is an offshore rig that provides power and has a chemical supply that provides additives to one or more injection units. In another embodiment, the surface facility includes a relatively stationary buoy and a mobile service vessel. When needed, the service vessel transfers additives to the chemical injection units via the buoy.

42 Claims, 5 Drawing Sheets

U.S. PATENT DOCUMENTS 6,539,778 B2 * 4/2003 Tucker et al. ..... 73/49.5
6,575,248 B2 * 6/2003 Zhang et al. ..... 166/338
6,640,900 B2 * 11/2003 Smith ..... 166/336
6,640,901 B1 * 11/2003 Appleford et al. ..... 166/357
6,663,361 B2 * 12/2003 Kohl et al. ..... 417/417
6,725,924 B2 * 4/2004 Davidson et al. ..... 166/250.01
6,772,840 B2 * 8/2004 Headworth ..... 166/302
6,869,251 B2 * 3/2005 Zou et al. ..... 405/205
2002/0004014 A1 1/2002 Kohl
2002/0011335 A1 1/2002 Zhang et al.
2004/0134662 A1 * 7/2004 Chitwood et al. ..... 166/367
2004/0253734 A1 * 12/2004 Firmin ..... 436/28
2004/0262008 A1 * 12/2004 Deans et al. ..... 166/339
2005/0137432 A1 * 6/2005 Matthews et al. ..... 585/15
2005/0178556 A1 * 8/2005 Appleford et al. ..... 166/366

* cited by examiner

SUBSEA CHEMICAL INJECTION UNIT FOR ADDITIVE INJECTION AND MONITORING SYSTEM FOR OILFIELD OPERATIONS

CROSS-REFERENCE TO RELATED APPLICATIONS

This application takes priority from U.S. Provisional Application Ser. No. 60/403,445 filed Aug. 14, 2002.

BACKGROUND OF THE INVENTION

1. Field of the Invention

This invention relates generally to oilfield operations and more particularly to a subsea chemical injection and fluid processing systems and methods.

2. Background of the Art

Conventional offshore production facilities often have a floating or fixed platforms stationed at the water's surface and subsea equipment such as a well head positioned over the subsea wells at the mud line of a seabed. The production wells drilled in a subsea formation typically produce fluids (which can include one or more of oil, gas and water) to the subsea well head. This fluid (wellbore fluid) is carried to the platform via a riser or to a subsea fluid separation unit for processing. Often, a variety of chemicals (also referred to herein as "additives") are introduced into these production wells and processing units to control, among other things, corrosion, scale, paraffin, emulsion, hydrates, hydrogen sulfide, asphaltenes, inorganics and formation of other harmful chemicals. In offshore oilfields, a single offshore platform (e.g., vessel, semi-submersible or fixed system) can be used to supply these additives to several producing wells.

The equipment used to inject additives includes at the surface a chemical supply unit, a chemical injection unit, and a capillary or tubing (also referred to herein as "conductor line") that runs from the offshore platform through or along the riser and into the subsea wellbore. Preferably, the additive injection systems supply precise amounts of additives. It is also desirable for these systems to periodically or continuously monitor the actual amount of the additives being dispensed, determine the impact of the dispersed additives, and vary the amount of dispersed additives as needed to maintain certain desired parameters of interest within their respective desired ranges or at their desired values.

In conventional arrangements, however, the chemical injection unit is positioned at the water surface (e.g., on the offshore platform or a vessel), which can be several hundred to thousands of feet) from the subsea wellhead. Moreover, the tubing may direct the additives to produced fluids in the wellbores located hundreds or thousands of feet below the seabed floor. The distance separating the chemical injection unit and the locus of injection activity can reduce the effectiveness of the additive injection process. For example, it is known that the wellbore is a dynamic environment wherein pressure, temperature, and composition of formation fluids can continuously fluctuate or change. The distance between the surface-located chemical injection unit and the subsea environment introduces friction losses and a lag between the sensing of a given condition and the execution of measures for addressing that condition. Thus, for instance, a conventionally located chemical injection unit may inject chemicals to remedy a condition that has since changed.

The present invention addresses the above-noted problems and provides an enhanced additive injection system suitable for subsea applications.

SUMMARY OF THE INVENTION

This invention provides a system and method for deployment of chemicals or additives in subsea oilwell operations. The chemicals used prevent or reduce build up of harmful elements, such as paraffin or scale and prevent or reduce corrosion of hardware in the wellbore and at the seabed, including pipes and also promote separation and/or processing of formation fluids produced by subsea wellbores. In one aspect, the system includes one or more subsea mounted tanks for storing chemicals, one or more subsea pumping systems for injecting or pumping chemicals into one or more wellbores and/or subsea processing units(s), a system for supplying chemicals to the subsea tanks, which may be via an umbilical interfacing the subsea tanks to a surface chemical supply unit or a remotely-controlled unit or vehicle that can either replace the empty subsea tanks with chemical filled tanks or fill the subsea tanks with the chemicals. The subsea tanks may also be replaced by any other conventional methods. The surface and subsea tanks may include multiple compartments or separate tanks to hold different chemicals which can be deployed into wellbores at different or same time. The subsea chemical injection unit can be sealed in a water-tight enclosure. The subsea chemical storage and injection system decreases the viscosity problems related to pumping chemicals from the surface through umbilical capillary tubings to a subsea installation location that may in some cases be up to 20 miles from the surface pumping station.

The system includes sensors associated with the subsea tank, the subsea pipes carrying the produced fluids, the wellbore, the umbilical and the surface facilities. The surface to subsea interface may use fiber optic cables to monitor the condition of the umbilical and the lines and provide chemical, physical and environmental data, such as chemical composition, pressure, temperature, viscosity etc. Fiber optic sensors along with conventional sensors may also be utilized in the system wellbore. Other suitable sensors to determine the chemical and physical characteristics of the chemical being injected into the wellbore and the fluid extracted from the wellbore may also be used. The sensors may be distributed throughout the system to provide data relating to the properties of the chemicals, the wellbore produced fluid, processed fluid at subsea processing unit and surface unit and the health and operation of the various subsea and surface equipment.

The surface supply units may include tanks carried by a platform or vessel or buoys associated with the subsea wells. Electric power at the surface may be generated from solar power or from conventional power generators. Hydraulic power units are provided for surface and subsea chemical injection units. Controllers at the surface alone or at subsea locations or in combination control the operation of the subsea injection system in response to one or parameters of interests relating to the system and/or in response to programmed instructions. A two-way telemetry system preferably provides data communication between the subsea system and the surface equipment. Commands from the surface unit are received by the subsea injection unit and the equipment and controllers located in the wellbores. The signals and data are transmitted between and/or among equipment, subsea chemical injection, fluid processing units, and surface equipment. A remote unit, such as at a land facility, may also be provided. The remote location then is made capable of controlling the operation of the chemical injection units of the system of the present invention.

In one embodiment, the present invention provides a subsea additive injection system for treating formation fluids. In one mode, the system injects, monitors and controls the supply of additives into fluids recovered through subsea production wellbores. The system can include a surface facility having a supply unit for supplying additives to a chemical injection unit located at a subsea location.

The chemical injection unit includes a pump and a controller. The pump supplies, under pressure, a selected additive from a chemical supply unit into the subsea wellbore via a suitable supply line. In one embodiment, one or more additives are pumped from an umbilical disposed on the outside of a riser extending to a surface facility. In another embodiment, the additives are supplied from one or more subsea tanks. The controller at a seabed location determines additive flow rate and controls the operation of the pump according to stored parameters in the controller. The subsea controller adjusts the flow rate of the additive to the wellbore to achieve the desired level of chemical additives.

The system of the present invention may be configured for multiple production wells. In one embodiment, such a system includes a separate pump, a fluid line and a subsea controller for each subsea well. Alternatively, a suitable common subsea controller may be provided to communicate with and to control multiple wellsite pumps via addressable signaling. A separate flow meter for each pump provides signals representative of the flow rate for its associated pump to the onsite common controller. The seabed controller at least periodically polls each flow meter and performs the above-described functions. If a common additive is used for a number of wells, a single additive source may be used. A single or common pump may also be used with a separate control valve in each supply line that is controlled by the controller to adjust their respective flow rates. The additive injection of the present invention may also utilize a mixer wherein different additives are mixed or combined at the wellsite and the combined mixture is injected by a common pump and metered by a common meter. The seabed controller controls the amounts of the various additives into the mixer.

The additive injection system may further include a plurality of sensors downhole which provide signals representative of one or more parameters of interest. Parameter of interest can include the status, operation and condition of equipment (e.g., valves) and the characteristics of the produced fluid, such as the presence or formation of sulfites, hydrogen sulfide, paraffin, emulsion, scale, asphaltenes, hydrates, fluid flow rates from various perforated zones, flow rates through downhole valves, downhole pressures and any other desired parameter. The system may also include sensors or testers that provide information about the characteristics of the produced fluid. The measurements relating to these various parameters are provided to the wellsite controller which interacts with one or more models or programs provided to the controller or determines the amount of the various additives to be injected into the wellbore and/or into a subsea fluid treatment unit and then causes the system to inject the correct amounts of such additives. In one aspect, the system continuously or periodically updates the models based on the various operating conditions and then controls the additive injection in response to the updated models. This provides a closed-loop system wherein static or dynamic models may be utilized to monitor and control the additive injection process. The additives injected using the present invention are injected in very small amounts. Preferably, the flow rate for an additive injected using the present invention is at a rate such that the additive is present at a concentration of from about 1 parts per million (ppm) to about 10,000 ppm in the fluid being treated.

The surface facility supports subsea chemical injection and monitoring activities. In one embodiment, the surface facility is an offshore rig that provides power and has a chemical supply that provides additives to one or more injection units. This embodiment includes an offshore platform having a chemical supply unit, a production fluid processing unit, and a power supply. Disposed outside of the riser are a power transmission line and umbilical bundle, which transfer electrical power and additives, respectively, from the surface facility to the subsea chemical injection unit. The umbilical bundle can include metal conductors, fiber optic wires, and hydraulic lines.

In another embodiment, the surface facility includes a relatively stationary buoy and a mobile service vessel. The buoy provides access to an umbilical adapted to convey chemicals to the subsea chemical injection unit. In one embodiment, the buoy includes a hull, a port assembly, a power unit, a transceiver, and one or more processors. The umbilical includes an outer protective riser, tubing adapted to convey additives, power lines, and data transmission lines having metal conductors and/or fiber optic wires. The power lines transmit energy from the power unit to the chemical injection unit and/or other subsea equipment. In certain embodiments, the transceiver and processors cooperate to monitor subsea operating conditions via the data transmission lines. Sensors may be positioned in the chemical supply unit, the production fluid processing unit, and the riser. The signals provided by these sensors can be used to optimize operation of the chemical injection unit. The service vessel includes a surface chemical supply unit and a docking station or other suitable equipment for engaging the buoy and/or the port. During deployment, the service vessel visits one or more buoys, and, pumps one or more chemicals to the chemical injection unit via the port and umbilical.

Examples of the more important features of the invention have been summarized rather broadly in order that the detailed description thereof that follows may be better understood and in order that the contributions they represent to the art may be appreciated. There are, of course, additional features of the invention that will be described hereinafter and which will form the subject of the claims appended hereto.

BRIEF DESCRIPTION OF THE DRAWINGS

For a detailed understanding of the present invention, reference should be made to the following detailed description of the one mode embodiments, taken in conjunction with the accompanying drawings, in which like elements have been given like numerals, wherein.

DETAILED DESCRIPTION OF THE PREFERRED EMBODIMENTS

Figure 1:
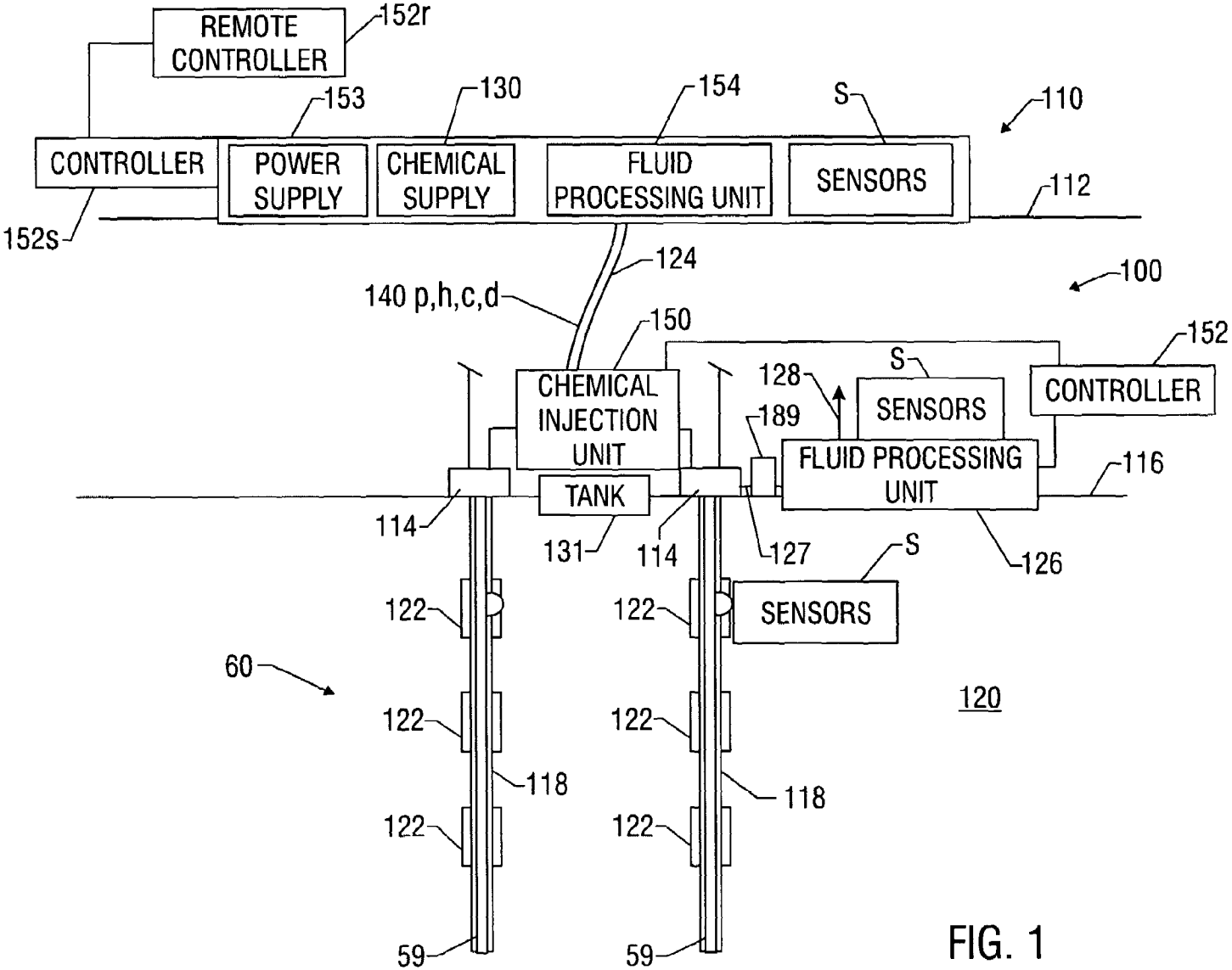
FIG. 1 is a schematic illustration of an offshore production facility having an additive injection and monitoring system made according to one embodiment of the present invention.

Referring initially to FIG. 1, there is schematically shown a chemical injection and monitoring system 100 (hereafter "system 100") made in accordance with the present invention. The system 100 may be deployed in conjunction with a surface facility 110 located at a water's surface 112 that services one or more subsea production wells 60 residing in a seabed 116. Conventionally, each well 60 includes a well head 114 and related equipment positioned over a wellbore 118 formed in a subterranean formation 120. The well bores 118 can have one or more production zones 122 for draining hydrocarbons from the formation 120 ("produced fluids" or "production fluid"). The production fluid is conveyed to a surface collection facility (e.g., surface facility 110 or separate structure) or a subsea collection and/or processing facility 126 via a line 127. The fluid may be conveyed to the surface facility 110-via a line 128 in an untreated state or, preferably, after being processed, at least partially, by the production fluid-processing unit 126.

The system 100 includes a surface chemical supply unit 130 at the surface facility 110, a single or multiple umbilicals 140 disposed inside or outside of the riser 124, one or more sensors S, a subsea chemical injection unit 150 located at a remote subsea location (e.g., at or near the seabed 116), and a controller 152. The sensors S are shown collectively and at representative 43locations; i.e., water surface, wellhead, and wellbore. In some embodiments, the system 100 can include a power supply 153 and a fluid-processing unit 154 positioned on the surface facility 110. The umbilical 140 can include hydraulic lines 140*h* for supplying pressurized hydraulic fluid, one or more tubes for supplying additives 140*c*, and power/data transmission lines 140*b* and 140*d* such as metal conductors or fiber optic wires for exchanging data and control signals. The chemical injection unit can be sealed in a water-tight enclosure.

During production operations, in one embodiment the surface chemical supply unit 130 supplies (or pumps) one or more additives to the chemical injection unit 150. The surface chemical supply unit 130 may include multiple tanks for storing different chemicals and one or more pumps to pump chemicals to the subsea tank 131. This supply of additives may be continuous. Multiple subsea tanks may be used to store a pre-determined amount of each chemical. These tanks 131 then are replenished as needed by the surface supply unit 130. The chemical injection unit 150 selectively injects these additives into the production fluid at one or more pre-determined locations. In a one mode of operation, the controller 152 receives signals from the sensors S regarding a parameter of interest which may relate to a characteristic of the produced fluid. The parameters of interest can relate, for example, to environmental conditions or the health of equipment. Representative parameters include but are not limited to temperature, pressure, flow rate, a measure of one or more of hydrate, asphaltene, corrosion, chemical composition, wax or emulsion, amount of water, and viscosity. Based on the data provided by the sensors S, the controller 152 determines the appropriate amount of one or more additives needed to maintain a desired or pre-determined flow rate or other operational criteria and alters the operation of the chemical injection unit 150 accordingly. A surface controller 152S may be used to provide signals to the subsea controller 152 to control the delivery of additives to the wellbore 118 and/or the processing unit 126.

Figure 2:
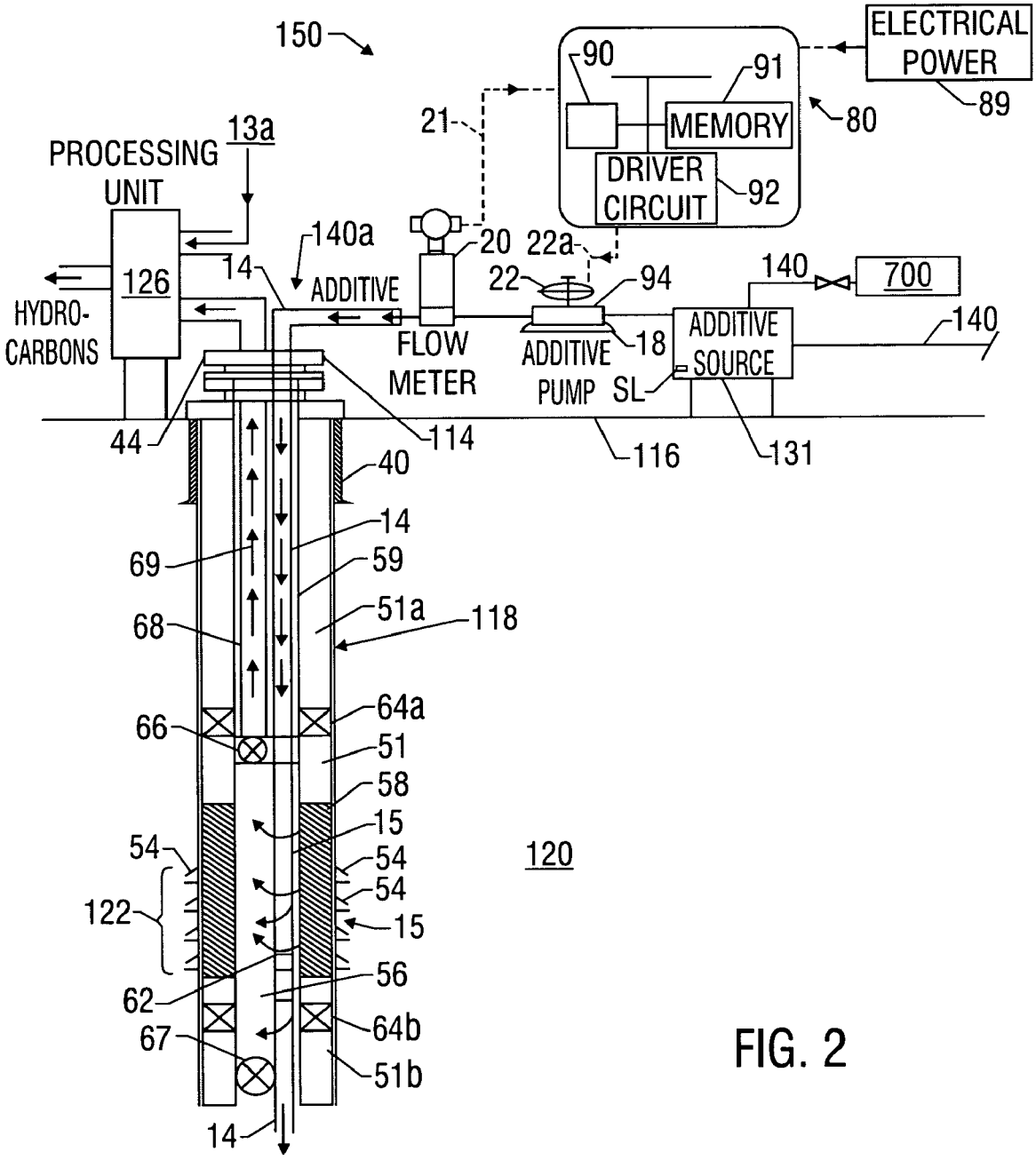
FIG. 2 is a schematic illustration of a additive injection and monitoring system according to one embodiment of the present invention.

Referring now to FIG. 2, there shown a schematic diagram of a subsea chemical injection system 150 according to one embodiment of the present invention. The system 150 is adapted to inject additives 13*a* into the wellbore 118 and/or into a subsea surface treatment or processing unit 126. The system 150 is further adapted to monitor pre-determined conditions (discussed later) and alter the injection process accordingly. The wellbore 118 is shown as a production well using typical completion equipment. The wellbore 118 has a production zone 122 that includes multiple perforations 54 through the formation 120. Formation fluid 56 enters a production tubing 59 in the well 118 via perforations 54 and passages 62. A screen 58 in the annulus 51 between the production tubing 59 and the formation 120 prevents the flow of solids into the production tubing 59 and also reduces the velocity of the formation fluid entering into the production tubing 59 to acceptable levels. An upper packer 64*a* above the perforations 54 and a lower packer 64*b* in the annulus 51 respectively isolate the production zone 122 from the annulus 51*a* above and annulus 51*b* below the production zone 122. A flow control valve 66 in the production tubing 59 can be used to control the fluid flow to the seabed surface 116. A flow control valve 67 may be placed in the production tubing 62 below the perforations 54 to control fluid flow from any production zone below the production zone 122.

A smaller diameter tubing 68, may be used to carry the fluid from the production zones to the subsea wellhead 114. The production well 118 usually includes a casing 40 near the seabed surface 116. The wellhead 114 includes equipment such as a blowout preventor stack 44 and passages 14 for supplying fluids into the wellbore 118. Valves (not shown) are provided to control fluid flow to the seabed surface 116. Wellhead equipment and production well equipment, such as shown in the production well 118, are well known and thus are not described in greater detail.

Referring still to FIG. 2, in one aspect of the present invention, the desired additive 13*a* is injected into the wellbore 118 via an injection line 14 by a suitable pump, such as a positive displacement pump 18 ("additive pump"). In one aspect, the additive 13*a* flows through the line 14 and discharges into the production tubing 60 near the production zone 122 via inlets or passages 15. The same or different injection lines may be used to supply additives to different production zones. In FIG. 2, line 14 is shown extending to a production zone below the zone 122. Separate injection lines allow injection of different additives at different well depths. The additives 13*a* may be supplied from a tank 131 that is periodically filled via the supply line 140. Alternatively, the additives 13*a* may be supplied directly from the surface chemical supply 130 via supply line 140*c*. The tank 131 may include multiple compartments and may be replaceable tanks which is periodically replaced. A level sensor $S_L$ can provide to the controller 152 or 152S (FIG. 1) indication of the additive remaining in the tank 131. When the additive level falls below a predetermined level, the tank is replenished or replaced. Alternatively a remotely operated vehicle 700 ("ROV") may be used to replenish the tank via feed line 140. The ROV 700 attaches to the supply line and replenishes the tank 131. Other conventional methods may be used to replace tank 131. Replaceable tanks are preferably quick disconnect types (e.g., mechanical, hydraulic, etc.). Of course, certain embodiments can include a combination of supply arrangements.

In one embodiment, a suitable high-precision, low-flow, flow meter 20 (such as gear-type meter or a nutating meter) measures the flow rate through line 14 and provides signals representative of the flow rate. The pump 18 is operated by a suitable device 22 such as a motor. The stroke of the pump 18 defines fluid volume output per stroke. The pump stroke and/or the pump speed are controlled, e.g., by a 4–20 milliamperes control signal to control the output of the pump 18. The control of air supply controls a pneumatic pump. Any suitable pump and monitoring system may be used to inject additives into the wellbore 118.

In one embodiment of the present invention, a seabed controller 80 controls the operation of the pump 18 by utilizing programs stored in a memory 91 associated with the subsea controller 80. The subsea controller 80 preferably includes a microprocessor 90, resident memory 91 which may include read only memories (ROM) for storing programs, tables and models, and random access memories (RAM) for storing data. The microprocessor 90 utilizes signals from the flow meter 20 received via line 21 and programs stored in the memory 91 to determine the flow rate of the additive. The wellsite controller 80 can be programmed to alter the pump speed, pump stroke or air supply to deliver the desired amount of the additive 13*a*. The pump speed or stroke, as the case may be, is increased if the measured amount of the additive injected is less than the desired amount and decreased if the injected amount is greater than the desired amount.

The seabed controller 80 preferably includes protocols so that the flow meter 20, pump control device 22, and data links 85 made by different manufacturers can be utilized in the system 150. In the oil industry, the analog output for pump control is typically configured for 0–5 VDC or 4–20 milliampere (mA) signal. In one mode, the subsea controller 80 can be programmed to operate for such output. This allows for the system 150 to be used with existing pump controllers. A power unit 89 provides power to the controller 80, converter 83 and other electrical circuit elements. The power unit 89 can include an AC power unit, an onsite generator, and/or an electrical battery that is periodically charged from energy supplied from a surface location. Alternatively, power may be supplied from the surface via a power line disposed along the riser 124 (discussed in detail below).

Still referring to FIG. 2, the produced fluid 69 received at the seabed surface 116 may be processed by a treatment unit or processing unit 126. The seabed processing unit 126 may be of the type that processes the fluid 69 to remove solids and certain other materials such as hydrogen sulfide, or that processes the fluid 69 to produce semi-refined to refined products. In such systems, it is desired to periodically or continuously inject certain additives. Thus, the system 150 shown in FIG. 1 can be used for injecting and monitoring additives 13*b* into the processing unit 126. These additives may be the same or different from the additives injected into the wellbore 118. These additives 13*b* are suitable to process the produced wellbore fluid before transporting it to the surface. In configuration of FIG. 2, the same chemical injection unit may be utilized to pump chemicals in multiple wellbores, subsea pipelines and/or subsea processing units.

In addition to the flow rate signals 21 from the flow meter 20, the seabed controller 80 may be configured to receive signals representative of other parameters, such as the rpm of the pump 18, or the motor 22 or the modulating frequency of a solenoid valve. In one mode of operation, the wellsite controller 80 periodically polls the meter 20 and automatically adjusts the pump controller 22 via an analog input 22*a* or alternatively via a digital signal of a solenoid controlled system (pneumatic pumps). The controller 80 also can be programmed to determine whether the pump output, as measured by the meter 20, corresponds to the level of signal 22*a*. This information can be used to determine the pump efficiency. It can also be an indication of a leak or another abnormality relating to the pump 18. Other sensors 94, such as vibration sensors, temperature sensors may be used to determine the physical condition of the pump 18. Sensors S that determine properties of the wellbore fluid can provide information of the treatment effectiveness of the additive being injected. Representative sensors include, but are not limited to, a temperature sensor, a viscosity sensor, a fluid flow rate sensor, a pressure sensor, a sensor to determine chemical composition of the production fluid, a water cut sensor, an optical sensor, and a sensor to determine a measure of at least one of asphaltene, wax, hydrate, emulsion, foam or corrosion. The information provided by these sensors can then be used to adjust the additive flow rate as more fully described below in reference to FIGS. 3 and 4.

It should be understood that a relatively small amount of additives are injected into the production fluid during operation. Accordingly, rather considerations such as precision in dispensing additives can be more relevant than mere volumetric capacity. Preferably, the flow rate for an additive injected using the present invention is at a rate such that the additive is present at a concentration of from about 1 parts per million (ppm) to about 10,000 ppm in the fluid being treated. More preferably, the flow rate for an additive injected using the present invention is at a rate such that the additive is present at a concentration of from about 1 ppm to about 500 ppm in the fluid being treated. Most preferably the flow rate for an additive injected using the present invention is at a rate such that the additive is present at a concentration of from about 10 ppm to about 400 ppm in the fluid being treated.

As noted above, it is common to drill several wellbores from the same location. For example, it is common to drill 10–20 wellbores from a single offshore platform. After the wells are completed and producing, a separate subsea pump and meter are installed to inject additives into each such wellbore.

Figure 3:
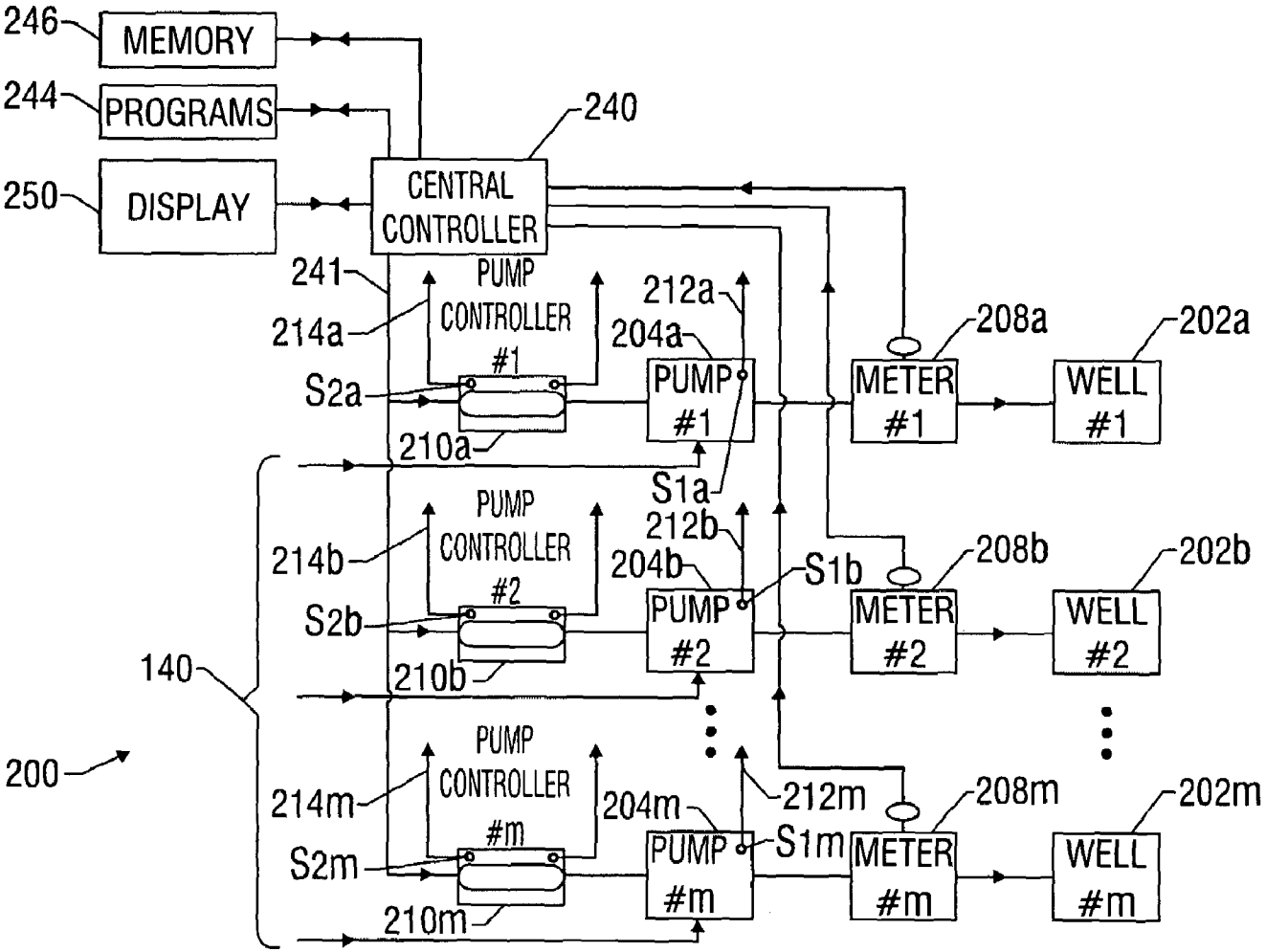
FIG. 3 shows a functional diagram depicting one embodiment of the system for controlling and monitoring the injection of additives into multiple wellbores, utilizing a central controller on an addressable control bus.

FIG. 3 shows a functional diagram depicting a system 200 for controlling and monitoring the injection of additives into multiple wellbores 202*a*–202*m* according to one embodiment of the present invention. In the system configuration of FIG. 3, a separate pump supplies an additive via supply lines 140 from a surface chemical supply 130 (FIG. 1) to each of the wellbores 202*a*–202*m*. For example, pump 204*a* supplies an additive and the meter 208*a* measures the flow rate of the additive into the wellbore 202*a* and provides corresponding signals to a central wellsite controller 240. The wellsite controller 240 in response to the flow meter signals and the programmed instructions controls the operation of pump control device or pump controller 210*a* via a bus 241 using addressable signaling for the pump controller 210*a*. Alternatively, the wellsite controller 240 may be connected to the pump controllers via a separate line. The wellsite controller 240 also receives signal from sensor S1*a* associated with pump 204*a* via line 212*a* and from sensor S2*a* associated with the pump controller 210*a* via line 212*a*. Such sensors may include rpm sensor, vibration sensor or any other sensor that provides information about a parameter of interest of such devices. Additives to the wells 202*b*–202*m* are respectively supplied by pumps 204*b*–204*m* from sources 206*b*–206*m*. Pump controllers 210*b*–210*m* respectively control pumps 204*b*–204*m* while flow meters 208*b* –208*m* respectively measure flow rates to the wells 202*b*–202*m*. Lines 212*b*–212*m* and lines 214*b*–214*m* respectively communicate signals from sensor $S_{1b}$–$S_{1m}$ and $S_{2b}$–$S_{2m}$ to the central controller 240. The controller 240 utilizes memory 246 for storing data in memory 244 for storing programs in the manner described above in reference to system 100 of FIG. 1. The individual controllers communicate with the sensors, pump controllers and remote controller via suitable corresponding connections.

The central wellsite controller 240 controls each pump independently. The controller 240 can be programmed to determine or evaluate the condition of each of the pumps 204*a*–204*m* from the sensor signals $S_{1a}$–$S_{1m}$ and $S_{2a}$–$S_{2m}$. For example the controller 240 can be programmed to determine the vibration and rpm for each pump. This can provide information about the effectiveness of each such pump.

Figure 4:
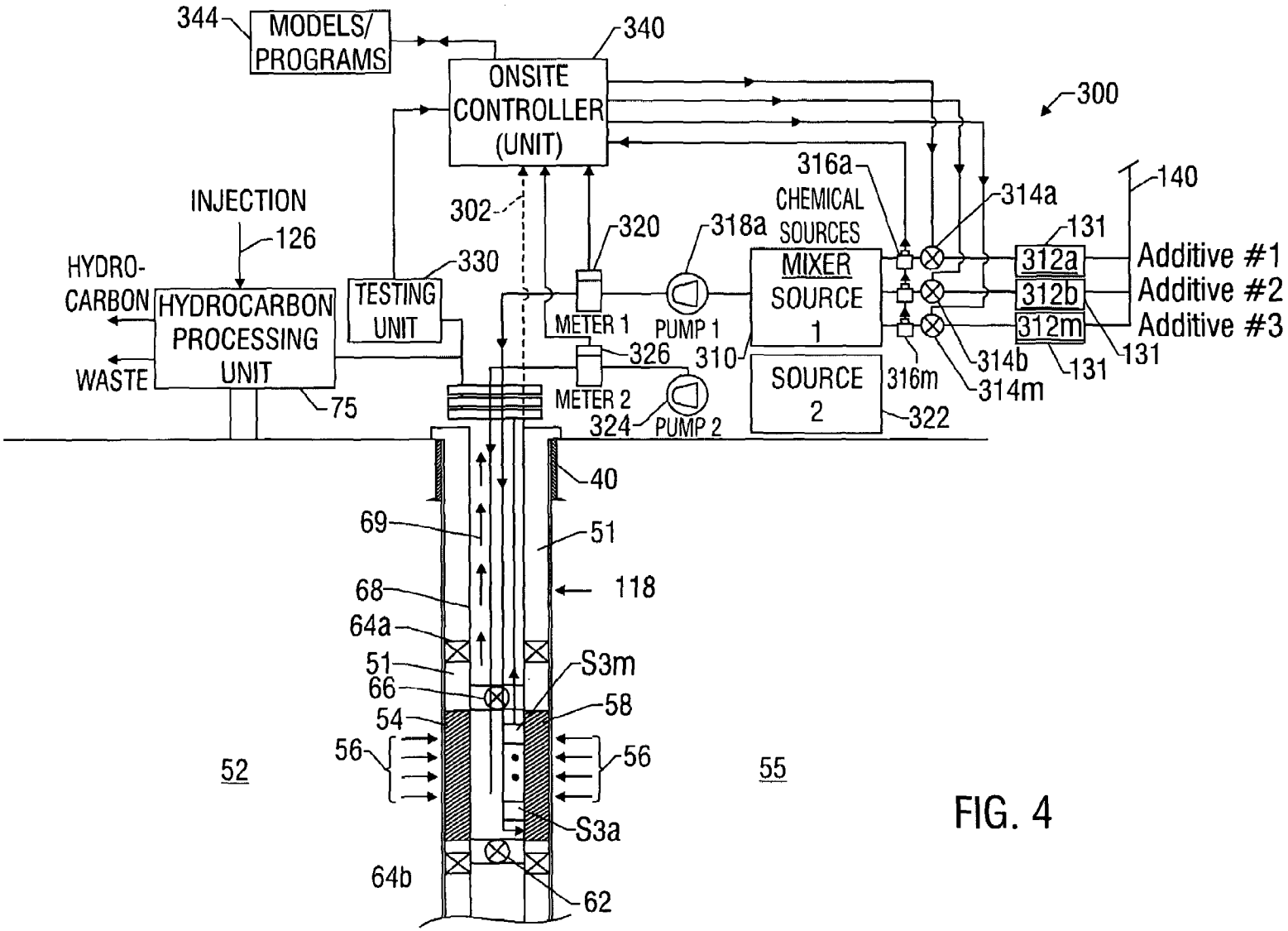
FIG. 4 is a schematic illustration of a wellsite additive injection system which responds to in-situ measurements of downhole and surface parameters of interests according to one embodiment of the present invention.

FIG. 4 is a schematic illustration of a closed-loop additive injection system 300 which responds to measurements of downhole and surface parameters of interest according to one embodiment of the present invention. Certain elements of the system 300 are common with the system 150 of FIG. 2. For convenience, such common elements have been designated in FIG. 4 with the same numerals as specified in FIG. 2.

The well 118 in FIG. 4 further includes a number of downhole sensors $S_{3a}$–$S_{3m}$ for providing measurements relating to various downhole parameters. The sensors may be is located at wellhead over the at least one wellbore, in the wellbore, and/or in a supply line between the wellhead and the subsea chemical injection unit. Sensor $S_{3a}$ provide a measure of chemical and physical characteristics of the downhole fluid, which may include a measure of the paraffins, hydrates, sulfides, scale, asphaltenes, emulsion, etc. Other sensors and devices $S_{3m}$ may be provided to determine the fluid flow rate through perforations 54 or through one or more devices in the well 118. These sensors may be distributed along the wellbore and may include fiber optic and other sensors. The signals from the sensors may be partially or fully processed downhole or may be sent uphole via signal/date lines 302 to a wellsite controller 340. In the configuration of FIG. 3, a common central control unit 340 is preferably utilized. The control unit is a microprocessor-based unit and includes necessary memory devices for storing programs and data.

The system 300 may include a mixer 310 for mixing or combining at the wellsite a plurality of additive #1–additive #m stored in sources 313*a*–312*m* respectively. The sources 313*a*–312*m* are supplied with additives via supply line 140. In some situations, it is desirable to transport certain additives in their component forms and mix them at the wellsite for safety and environmental reasons. For example, the final or combined additives may be toxic, although while the component parts may be non-toxic. Additives may be shipped in concentrated form and combined with diluents at the wellsite prior to injection into the well 118. In one embodiment of the present invention, additives to be combined, such as additives additive #1–additive #m are metered into the mixer by associated pumps 314*a*–314*m*. Meters 316*a*–316*m* measure the amounts of the additives from sources 312*a*–312*m* and provide corresponding signals to the control unit 340, which controls the pumps 314*a*–314*m* to accurately dispense the desired amounts into the mixer 310. A pump 318 pumps the combined additives from the mixer 310 into the wellbore 118, while the meter 320 measures the amount of the dispensed additive and provides the measurement signals to the controller 340. A second additive required to be injected into the well 118 may be stored in the source tank 131, from which source a pump 324 pumps the required amount of the additive into the well. A meter 326 provides the actual amount of the additive dispensed from the source tank 131 to the controller 340, which in turn controls the pump 324 to dispense the correct amount.

The wellbore fluid reaching the surface may be tested on site with a testing unit 330. The testing unit 330 provides measurements respecting the characteristics of the retrieved fluid to the central controller 340. The central controller utilizing information from the downhole sensors $S_{3a}$–$S_{3m}$, the tester unit data and data from any other surface sensor (as described in reference to FIG. 2) computes the effectiveness of the additives being supplied to the well 118 and determine therefrom the correct amounts of the additives and then alters the amounts, if necessary, of the additives to the required levels. The controller 340 may also receive commands from the surface controller 152*s* and/or a remote controller 152*s* to control and/or monitor the wells 202*a*–202*m*

Thus, the system of the present invention at least periodically monitors the actual amounts of the various additives being dispensed, determines the effectiveness of the dispensed additives, at least with respect to maintaining certain parameters of interest within their respective predetermined ranges, determines the health of the downhole equipment, such as the flow rates and corrosion, determines the amounts of the additives that would improve the effectiveness of the system and then causes the system to dispense additives according to newly computed amounts. The models 344 may be dynamic models in that they are updated based on the sensor inputs.

The system of the present invention can automatically take broad range of actions to assure proper flow of hydrocarbons through pipelines, which not only can minimize the formation of hydrates but also the formation of other harmful elements such as asphaltenes. Since the system 300 is closed loop in nature and responds to the in-situ measurements of the characteristics of the treated fluid and the equipment in the fluid flow path, it can administer the optimum amounts of the various additives to the wellbore or pipeline to maintain the various parameters of interest within their respective limits or ranges.

Figure 5A:
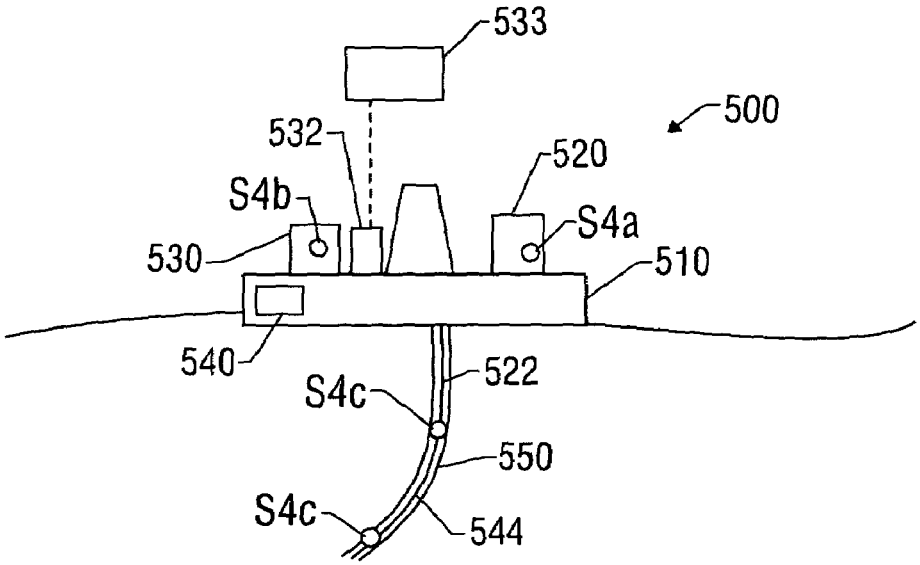
FIG. 5A is a schematic illustration of a surface facility having a platform according to one embodiment of the present invention.

Referring now to FIG. 5A, there is shown one embodiment of a surface facility and a remote control station for supporting and controlling the subsea chemical injection and monitoring activities of a subsea chemical injection system, such as system 150 of FIG. 1. The FIG. 5A surface facility 500 can provide power and additives as needed to one or more subsea chemical injection units 150 (FIG. 1). Also, the surface facility 500 includes equipment for processing, testing and storing produced fluids. A one mode surface facility 500 includes an offshore platform or rig or a vessel 510 having a chemical supply unit 520, a production fluid processing unit 530, a power supply 540, a controller 532 and may include a remote controller 533 via a satellite or other long distance means. The chemical supply unit 520 may include separate tanks for each type of chemical desired to be supplied therefrom to the chemical injection unit 150 (FIG. 1) via a supply line or umbilical bundle 522 that is disposed inside or outside of a riser 550. Each chemical/additive can either have a dedicated supply line (i.e., multiple lines) or share one or more supply lines. Likewise, the umbilical bundle 522 can include power and/or data transmission lines 544 for transmitting power from the power supply 540 to the subsea components of the system 100 and transmitting data and control signals between the surface controller 532 and the subsea controller 152 (FIG. 1). Suitable lines 544 include fiber optic wires and metal conductors adapted to convey data, electrical signals and power. The processing unit 530 receives produced fluid from the well head 114 (FIG. 1) via the riser 550. Sensors $S_4$ may be positioned in the chemical supply unit 520, the production fluid processing unit 530, and the riser 550 (sensors $S_{4a-c}$, respectively). Sensors S4*c* may be distributed along the riser and/or umbilical to provide signals representative of fluid flow, physical and chemical characteristics of the additives and production fluid and environmental conditions. As explained earlier, measurement provided by these sensors can be used to optimize operation of the chemical injection unit 150 (FIG. 1). It will be appreciated that a single surface facility as shown in FIG. 5A may be used to service multiple subsea oilfields.

Figure 5B:
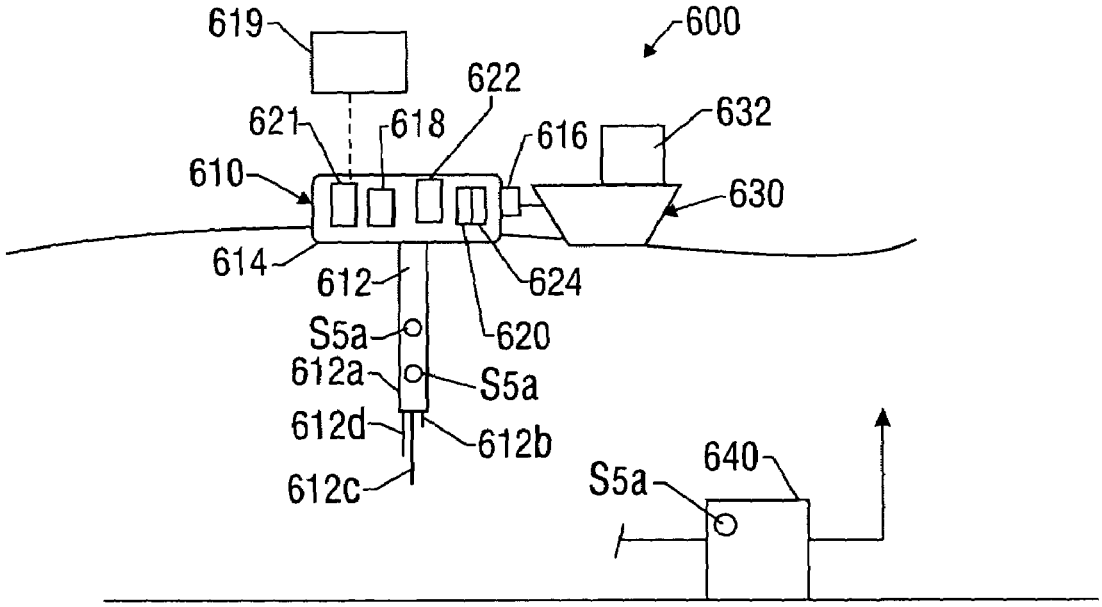
FIG. 5B is a schematic illustration of a surface facility having a service vessel and buoy made according to one embodiment of the present invention.

Referring now to FIG. 5B, there is shown another embodiment of a surface facility. The FIG. 5B surface facility 600 supplies additives on-demand or on a predetermined basis to the chemical injection unit 150 (FIG. 1) without using a dedicated chemical supply unit. A one mode surface facility 600 includes a buoy 610 and a service vessel 630.

The buoy 610 provides a relatively stationary access to an umbilical 611 and a riser 612 adapted to convey power, data, control signals, and chemicals to the chemical injection unit 150 (FIG. 1). The buoy 610 includes a hull 614, a port assembly 616, a power unit 618, a transceiver 620, and one or more processors 624. The hull 614 is of a conventional design and can be fixed, floating, semi-submersed, or full submersed. In certain embodiments, the hull 614 can include known components such as ballast tanks that provide for selective buoyancy. The port 616 is suitably disposed on the hull 614 and is in fluid communication with the conduit 612. The conduit 612 includes an outer protective riser 612*a* and the umbilical 611, which can include single or multiple tubing 612*b* adapted to convey chemicals and additives, power lines 612*c*, and data transmission lines 612*d*. The power lines 612*d* transmit stored or generated power of the power unit 618 to the chemical injection unit (FIG. 1) and/or other subsea equipment. The power lines 612*d* can also include hydraulic lines for conveying hydraulic fluid to subsea equipment. Power may be generated by a conventional generator 622 and/or stored in batteries 621 which can be charged via a solar power generation system 619. The transceiver 620 and processors 624 cooperate to monitor subsea operating conditions via the data transmission lines 612*d*. The data transmission lines can use metal conductors or fiber optic wires. In certain embodiments, the transceiver 620 and processors 624 can determine whether any subsea equipment is malfunctioning or whether the chemical injection unit 130 (FIG. 1) will exhaust its supply of one or more additives. Upon making such a determination, the transceiver 620 can be used to transmit this determination to a control facility (not shown). Sensors $S_5$ may be positioned in the production fluid processing unit 640 (sensor $S_{5a}$), the riser 612 (sensor $S_{5b}$), or other suitable location. As explained earlier, measurement provided by these sensors can be used to optimize operation of the chemical injection unit 130 (FIG. 1). The subsea chemical injection unit can be sealed in a water-tight enclosure.

The service vessel 630 includes a surface chemical supply unit 632 and a suitable equipment (not shown) for engaging the buoy 610 and/or the port 616. The service vessel 630 may be self-powered (e.g., a ship or a towed structure). During deployment, the service vessel 630 visits one or more buoys 610 on a determined schedule or on an as-needed basis. Upon making up a connection to the port 616, one or more chemicals is pumped down to the chemical storage tank 130 (FIG. 1) via the tubing 612*b*. After the pumping operation is complete, the buoy 610 is released and the service vessel 630 is free to visit other buoys 610. It should be appreciated that the buoy 630 according to the present invention are less expensive than conventional offshore platforms.

Produced fluid from the well head 114 (FIG. 1) is conveyed via a line 632 to a fluid processing unit 640. The processed produced fluids are then transferred to a surface or subsea collection facility via line 642.

Referring to FIG. 1, 5A and 5B, the system may further include devices that heat production fluid in subsea lines, such as line 127. The power for heating devices (189) can be tapped from power supplied by the surface unit to the subsea chemical injection unit 150 or to any other subsea device, such as wellhead valves. The sensors S monitor the condition of the production fluid. The system of FIGS. 1–5 controls and monitors the injection of chemicals into subsea wellbores 118. A subsea chemical injection alone can control and monitor the injection of chemicals into wellbores 118 and underwater processing facility 126. The system can also monitor the fluid lines 127. The unit 150 can control and monitor the chemical injection in response to various sensor measurements or according to programmed instructions. The chemical sensor in the system provides information from various places along the wellbore 118, pipe 127, fluid processing unit 126, and riser 124 or 160. The other sensors provide information about the physical or environmental conditions. The subsea controller 152, the surface controller 152*s* and the remote controller 152*r* cooperate with each other and in response to one or more sensor measurements in parameters of interest control and/or monitor the operation of the entire system shown in FIGS. 1–5.

While the foregoing disclosure is directed to the one mode embodiments of the invention, various modifications will be apparent to those skilled in the art. It is intended that all variations within the scope and spirit of the appended claims be embraced by the foregoing disclosure.

What is claimed is:

1. A system for injecting one or more additives into production fluid produced by at least one subsea well, the system comprising:

a) a surface chemical supply unit for supplying at least one chemical to a selected subsea location;

b) at least one chemical supply line for carrying the at least one chemical from the surface to the selected subsea location; and c) a subsea chemical injection unit at the selected subsea location receiving the at least one chemical from the surface chemical supply unit and selectively injecting the at least one chemical into the production fluid flowing from the at least one subsea well to a surface location using a subsea pump.

2. The system of claim 1 further comprising a controller that controls the amount of the at least one chemical injected in response to at least one parameter of interest.

3. The system of claim 2 wherein the parameter of interest is one of (i) temperature, (ii) pressure, (iii) flow rate, (iv) a measure of one of hydrate, asphaltene, corrosion, chemical composition, wax or emulsion, (v) amount of water, and (vi) viscosity.

4. The system of claim 3 further comprising at least one sensor for providing information about the at least one parameter interest, said at least one sensor being selected from a group consisting of a temperature sensor, a viscosity sensor, a fluid flow rate sensor, a pressure sensor, a sensor to determine chemical composition of the production fluid, a water cut sensor, an optical sensor, and a sensor to determine a measure of at least one of asphaltene, wax, hydrate, emulsion, foam and corrosion.

5. The system of claim 1 wherein the subsea chemical injection unit includes a storage unit for storing the at least one chemicals supplied by the surface chemical supply unit.

6. The system of claim 5 wherein the at least one chemical supply line includes a plurality of lines for carrying a plurality of chemicals to the subsea chemical injection unit.

7. The system of claim 6 wherein the surface chemical supply unit supplies a plurality of chemicals to the subsea chemical injection unit via the plurality of lines.

8. The system of claim 1 wherein the surface chemical supply unit is located on an offshore rig and the subsea chemical injection unit is positioned proximate the at least one subsea well.

9. The system of claim 1 wherein the surface chemical supply unit includes a buoy at the sea surface and wherein the at least one chemical supply line carries chemicals from the buoy to the selected subsea location.

10. The system of claim 9 wherein the buoy includes a chemical storage unit that is periodically filled.

11. The system of claim 10 wherein the at least one supply line includes a plurality of supply lines, one for each chemical, between the buoy and the selected subsea location.

12. The system of claim 1 wherein the subsea chemical injection unit further comprises a manifold for mixing at least two chemicals prior to injecting the at least two chemicals into the production fluid as the production fluid flows from the at least one subsea well.

13. The system of claim 1 wherein the subsea chemical injection unit further comprises a control valve controlling the amount of the at least one chemical injected into the at least one subsea well.

14. The system of claim 1 further comprising a subsea power unit for supplying power to the chemical injection unit.

15. The system of claim 14 wherein the subsea power unit includes an electrical battery that is periodically charged from energy supplied from a surface location.

16. The system of claim 1 further comprising a riser for transporting production fluid to the surface and wherein the at least one chemical supply line is located at one of (i) inside the riser, and (ii) outside the riser.

17. The system of claim 1 further comprising a plurality of sensors distributed along a production fluid path.

18. The system of claim 4 wherein the at least one sensor is located at one of (i) wellhead over the at least one wellbore, (ii) in the wellbore, and (iii) in a supply line between the wellhead and the subsea chemical injection unit.

19. The system of claim 1 wherein the at least one subsea well includes a plurality of wells and the subsea chemical injection unit separately supplies the at least one chemical to each said subsea well.

20. The system of claim 1 further comprising a subsea fluid-processing unit receiving the production fluid via a line coupled to the subsea wellhead, the at least one chemical being injected into the line.

21. The system of claim 1 wherein the subsea chemical injection unit injects the at least one chemical into one of (i) the at least one subsea well, and (ii) subsea pipeline coupled to the at least one subsea well and, the subsea pipeline carrying the production fluid.

22. The system of claim 1 further comprising a heating device deployed subsea to heat the production fluid.

23. The system of claim 1 further comprising a surface controller for controlling one of: (i) at least in part the operation of the subsea chemical injection unit and (ii) the supply of the at least one chemical.

24. The system of claim 23 further comprising a remote controller providing command signals to the surface controller to control the injection of the at least one chemical.

25. The system of claim 1 further comprising a plurality of distributed sensors associated with said at least one chemical supply line for providing signals relating to a characteristic of the at least one chemical carried by the at least one chemical supply line.

26. The system of claim 25 wherein the surface chemical supply unit controls the supply of the at least one chemical in response to the signals relating to the characteristic of the at least one chemical in the supply line.

27. The system of claim 22 further comprising a power unit at the surface that provides power to the heating device.

28. The system of claim 20 wherein the processing unit refines at least partially the production fluid.

29. The system of claim 28 further comprising a fluid line carrying processed fluid from the processing unit to the surface.

30. A flow assurance method for fluid produced by at least one subsea well comprising:

a) providing a surface chemical supply unit at a location remote from the at least one subsea well for supplying at least one chemical to a selected subsea location;

b) providing at least one chemical supply line for carrying the at least one chemical from the surface to the selected subsea location;

c) measuring a parameter of interest relating to a characteristic of the production fluid; and d) providing a subsea chemical injection unit at the selected subsea location for receiving the at least one chemical from the surface chemical supply unit via the at least one chemical supply line and for selectively pumping the at least one chemical into the production fluid flowing from the at least one subsea well to a surface location using a subsea pump, at least in part in response to the parameter of interest.

31. The method of claim 30 wherein measuring the parameter of interest includes measuring one of temperature, viscosity, fluid flow rate, pressure and chemical composition of the produced fluid, a measure of asphaltene, wax, hydrate, emulsion, foam, corrosion, or water, and an optical property of the production fluid.

32. The method of claim 30 further comprising locating an end of the at least one chemical supply line at a buoy at the water surface.

33. The method of claim 32 further comprising moving the surface chemical supply unit to the buoy to supply the at least one chemical to the subsea chemical injection unit via the at least one supply line.

34. The method of claim 32 wherein the at least one supply line includes a plurality of supply lines and the surface chemical supply unit pumps a separate chemical through each of the plurality of supply lines.

35. The method of claim 30 wherein the subsea chemical injection unit includes: (i) a flow control valve; and (ii) a controller that controls the flow control valve to control the amount of chemical injected into the at least one subsea well.

36. A system for injecting a chemical into formation fluid produced by at least one subsea well, comprising: (i) a surface facility supplying a desired chemical; and (ii) an underwater chemical injection unit receiving the chemical via a line from the surface facility and injecting the chemical into the formation fluid produced by the at least one subsea well by pumping the chemical with a subsea pump into the production fluid flowing from the at least one subsea well to a surface location and before the production fluid reaches a surface location.

37. The system of claim 36 further comprising at least one sensor providing a measurement of a parameter of interest.

38. The system of claim 37 wherein the underwater chemical injection unit includes a controller that controls at least in part the injection of the chemical in response to the parameter of interest.

39. The system of claim 37 wherein the parameter of interest is one of: (i) a physical property of the formation fluid; (ii) a chemical property of the formation fluid; or (iii) a parameter relating to a device associated with the at least one subsea well.

40. The system of claim 36 wherein the chemical injection unit injects the chemical at a location along the production fluid between the at least one wellhead and a surface location.

41. The system of claim 37 wherein the chemical supply system includes: (i) an underwater storage tank for storing the chemical therein; and (ii) a chemical supply unit at the sea surface that supplies the chemical to the underwater storage tank.

42. The system of claim 36 wherein the chemical supply system includes an underwater chemical storage tank that is adapted to be one of: (i) refillable by a remotely operated device and (ii) replaceable via a quick disconnect.

* * * * *